US009688464B2

(12) United States Patent
Chandra et al.

(10) Patent No.: US 9,688,464 B2
(45) **Date of Patent: *Jun. 27, 2017**

(54) BREATHABLE CONTAINER FOR FRUITS AND VEGETABLES

(71) Applicants: Shubham Chandra, Milford, MA (US); Benjamin Scott Williams, East Walpole, MA (US)

(72) Inventors: Shubham Chandra, Milford, MA (US); Benjamin Scott Williams, East Walpole, MA (US)

(73) Assignee: Infinibox, LLC, Westwood, MA (US)

( * ) Notice: Subject to any disclaimer, the term of this patent is extended or adjusted under 35 U.S.C. 154(b) by 810 days.

This patent is subject to a terminal disclaimer.

(21) Appl. No.: 13/729,243

(22) Filed: Dec. 28, 2012

(65) Prior Publication Data

US 2013/0341236 A1 Dec. 26, 2013

Related U.S. Application Data

(63) Continuation-in-part of application No. 12/852,590, filed on Aug. 9, 2010, now Pat. No. 8,367,567.

(51) Int. Cl.

| | |
|---|---|
| ***B65D 85/72*** | (2006.01) |
| ***B65D 85/34*** | (2006.01) |
| ***D06N 3/12*** | (2006.01) |
| ***B65D 81/24*** | (2006.01) |

(52) U.S. Cl.

CPC ..... *B65D 85/72* (2013.01); *B65D 81/245* (2013.01); *B65D 85/345* (2013.01); *D06N 3/128* (2013.01); *D06N 2211/20* (2013.01)

(58) Field of Classification Search

USPC ..... 442/76; 95/12, 51; 206/521.1, 521.15

See application file for complete search history.

(56) References Cited

U.S. PATENT DOCUMENTS

| | | | | |
|---|---|---|---|---|
| 6,461,702 | B2 * | 10/2002 | Gong | A23B 7/148 426/118 |
| 7,772,139 | B2 * | 8/2010 | Chandra | 442/72 |
| 8,367,567 | B2 * | 2/2013 | Chandra et al. | 442/76 |
| 2004/0195115 | A1 * | 10/2004 | Colombo | 206/204 |

* cited by examiner

*Primary Examiner* — Lynda Salvatore

(74) *Attorney, Agent, or Firm* — Chapin Intellectual Property Law, LLC

(57) ABSTRACT

The Breathable Container for fruits and vegetables extends the shelf life of various fresh fruits and vegetables and vase life of fresh cut flowers by changing the atmosphere in which these living products are stored and respires. The Breathable Container does this by utilizing a Gas Permeable Non-Woven Fabric Based Film. The high oxygen and carbon dioxide permeability of the Gas Permeable Non-Woven Fabric Based Film establishes an ideal atmosphere for the perishable items stored within the Breathable Container, and therefore extends their shelf life. The establishment of lower oxygen and carbon dioxide atmospheres within the Breathable Container using the Gas Permeable Film, also leads to a reduction in the respiration rate of the perishable items stored. The reduction in the respiration rate of the perishable items prevents loss of moisture, production of metabolic heat, yellowing, browning, and reduces the production levels of ethylene by the perishable items.

22 Claims, 12 Drawing Sheets

EXTERIOR OF THE BREATHABLE CONTAINER

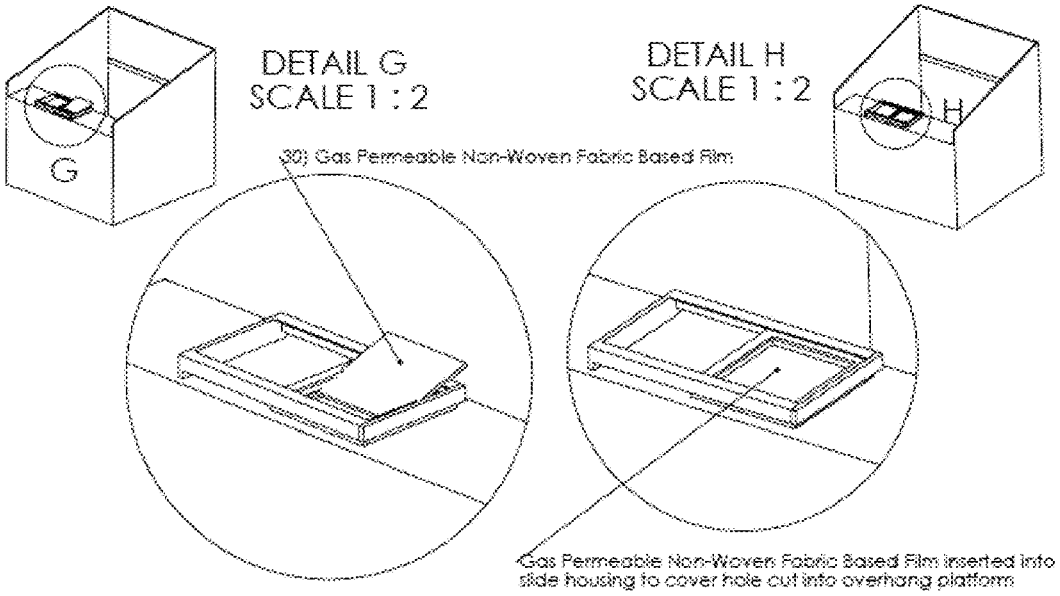
FIGURE 1: BREATHABLE CONTAINER WITH GAS PERMEABLE NON-WOVEN FABRIC FILM

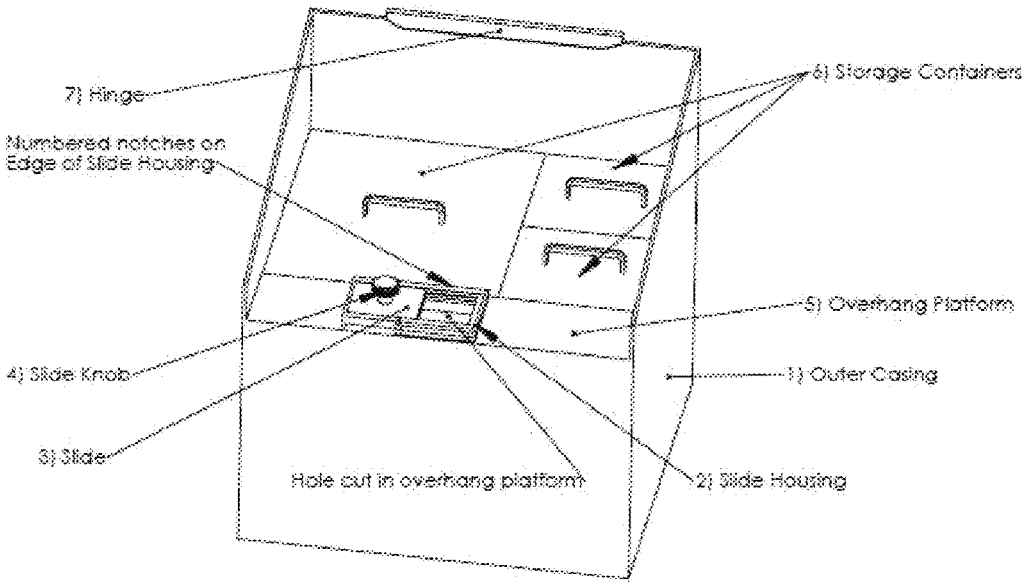
FIGURE 2: KEY COMPONENTS OF THE BREATHABLE CONTAINER WITHOUT THE GAS PERMEABLE NON-WOVEN FABRIC FILM

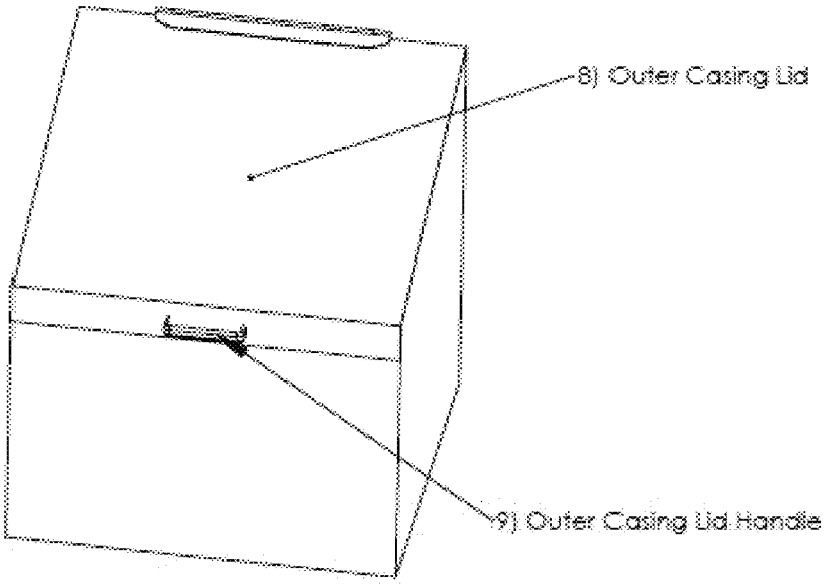
FIGURE 3: EXTERIOR OF THE BREATHABLE CONTAINER

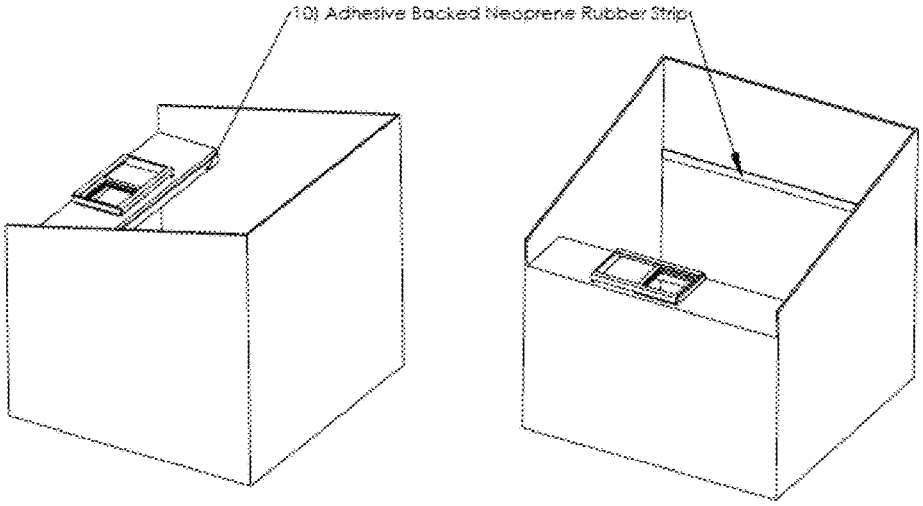
FIGURE 4: LOCATION OF THE ADHSEIVE BACKED NEOPRENE RUBBER STRIP IN THE BREATHABLE CONTAINER

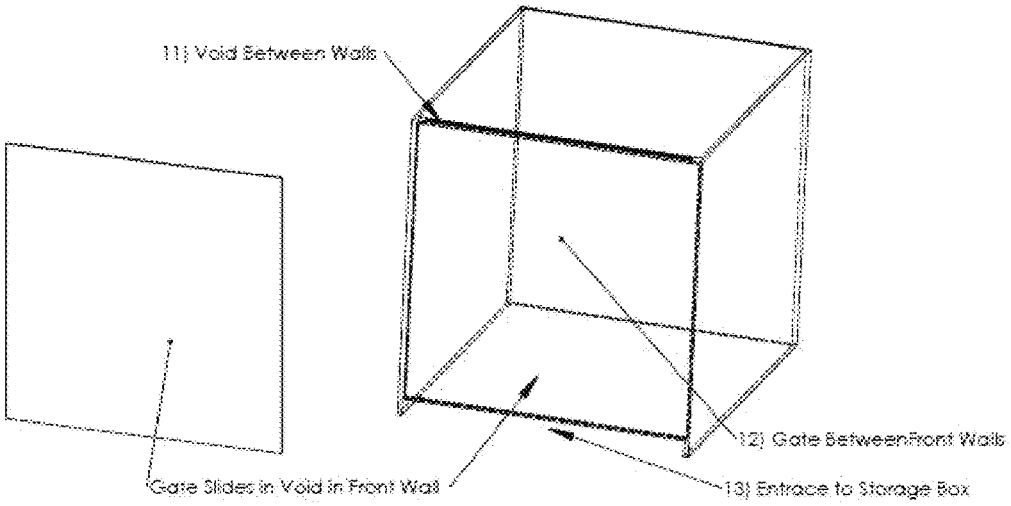
FIGURE 5: Large Storage Box

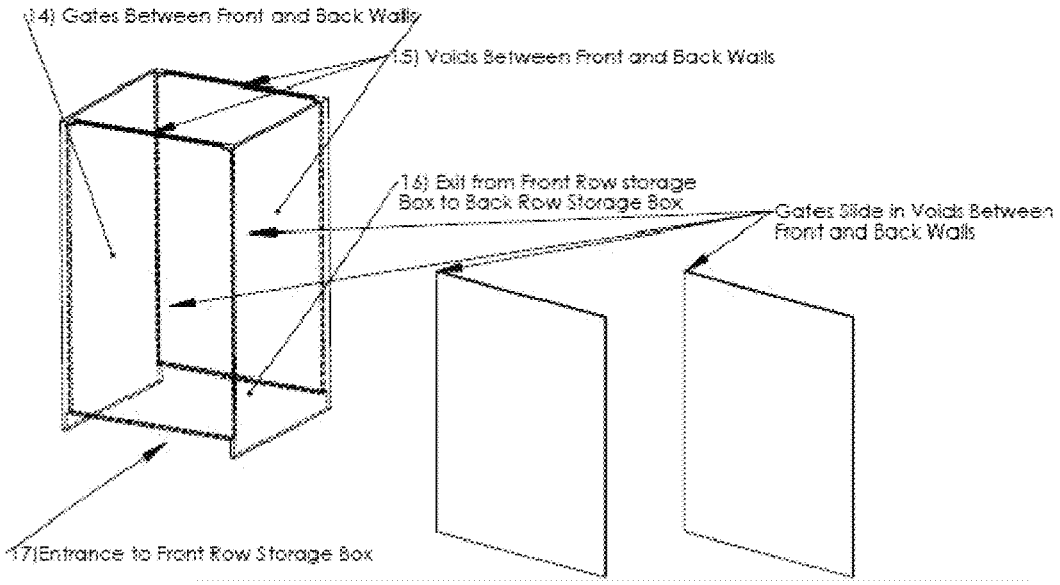
FIGURE 6: FRONT Small Storage Box

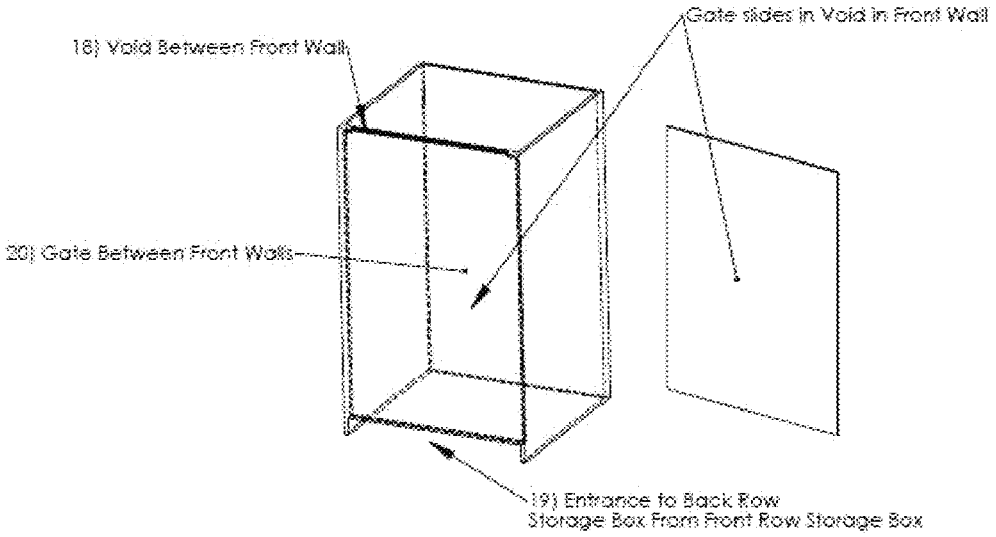
FIGURE 7: Rear Small Storage Box

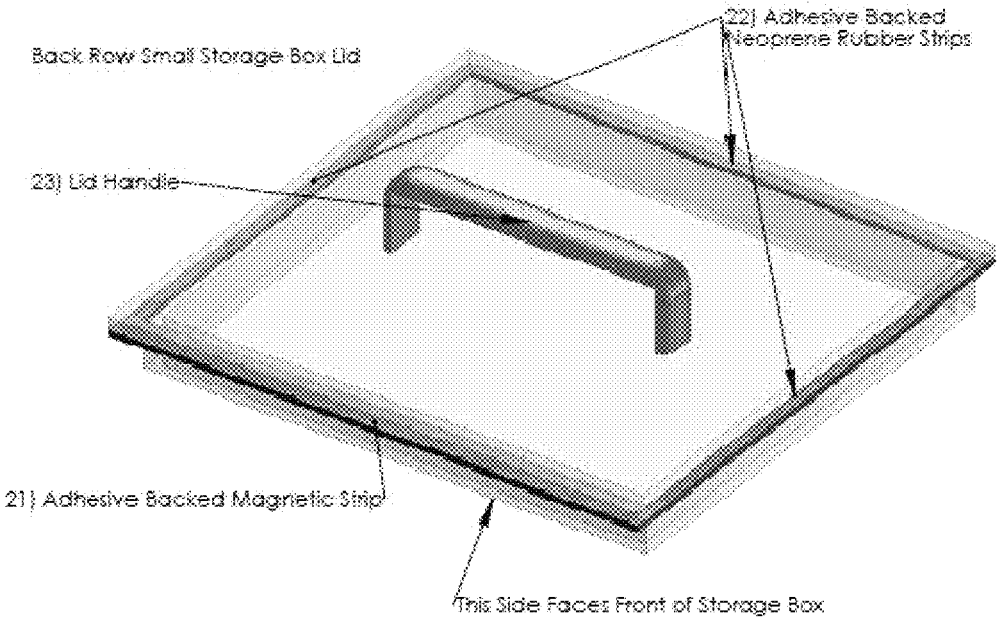
FIGURE 8: BACK ROW SMALL STORAGE BOX LID

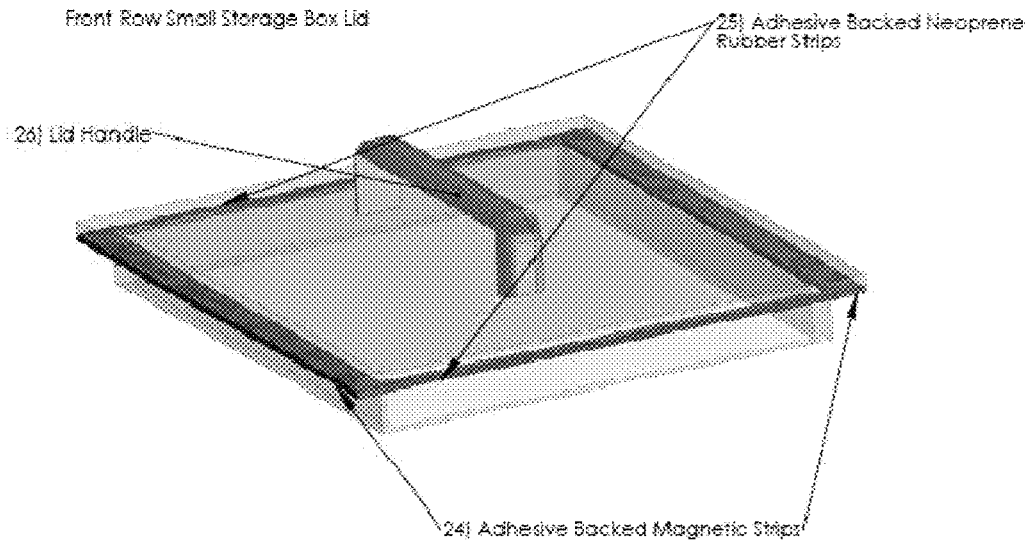
FIGURE 9: FRONT ROW SMALL STORAGE BOX LID

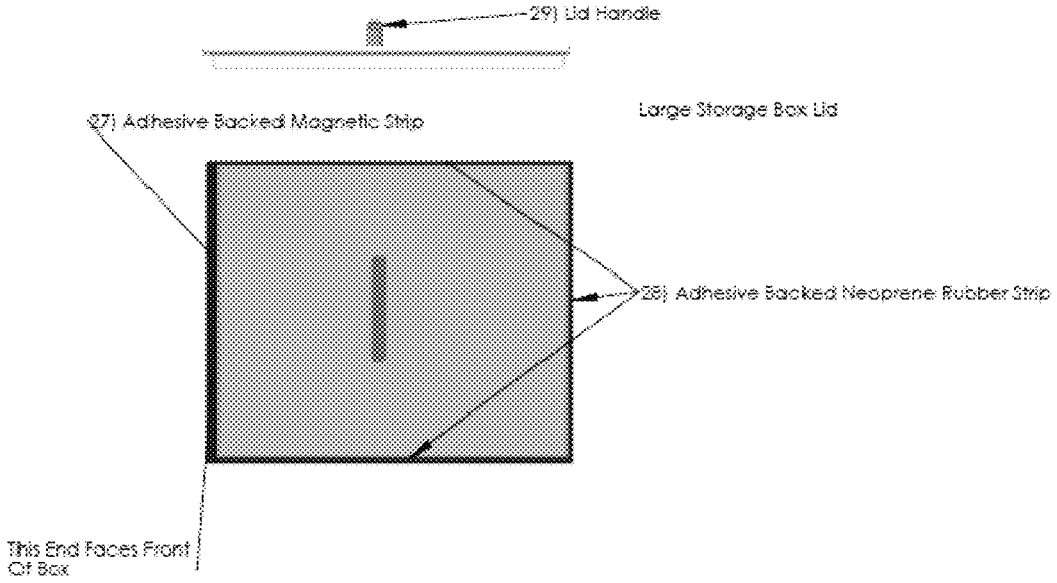
FIGURE 10: Large Storage Box Lid

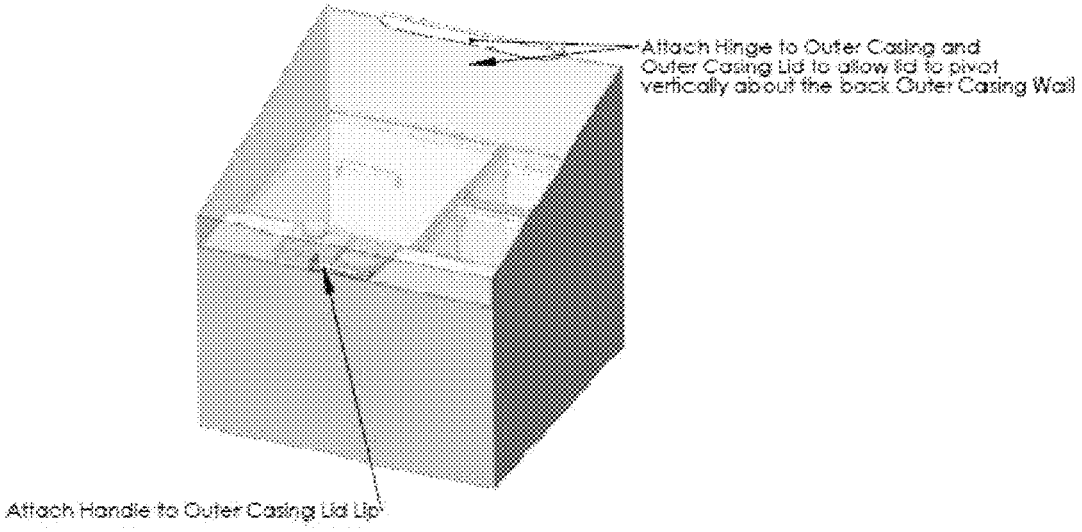
FIGURE 11: LOCATION OF THE HANDLE AND HINGE ON THE CONTAINER

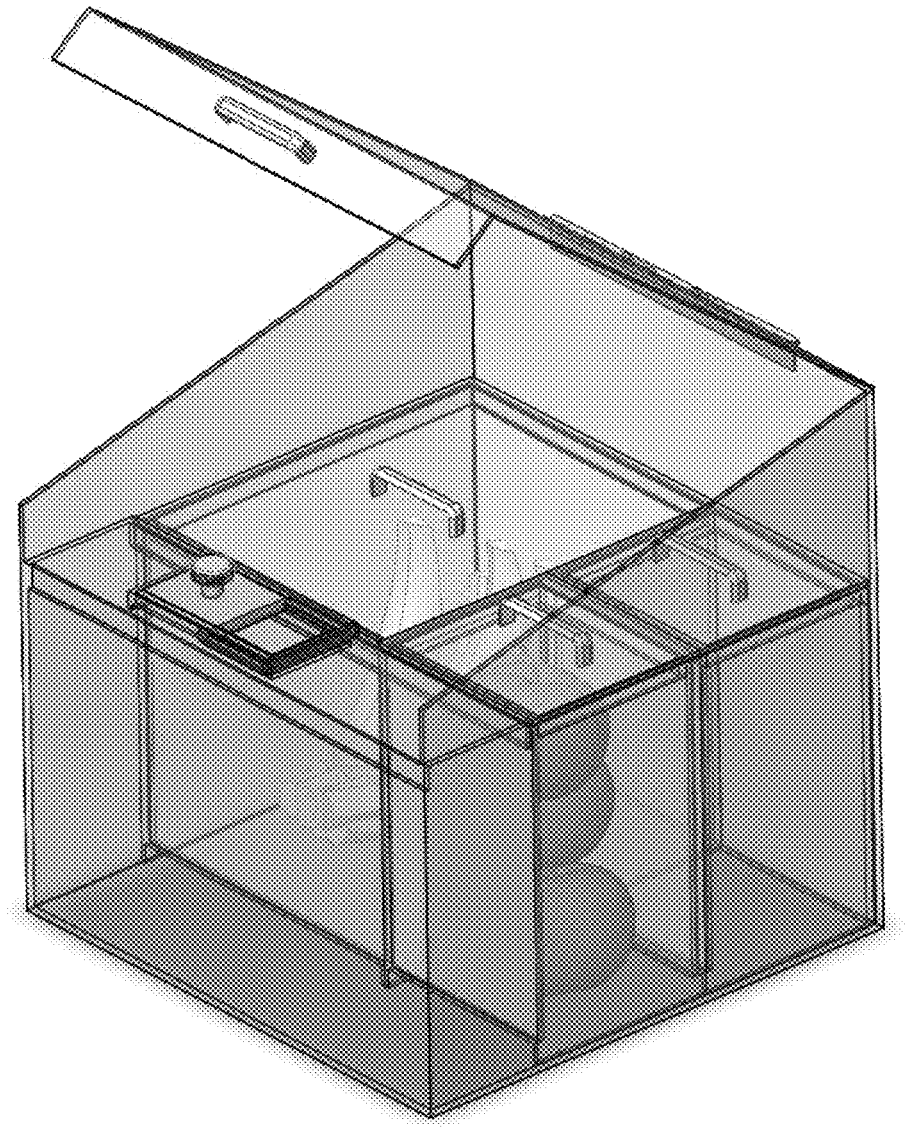
FIGURE 12: THE BREATHABLE CONTAINER WITH PRODUCE.

BREATHABLE CONTAINER FOR FRUITS AND VEGETABLES

This is a continuation application to the patent application Ser. No. 12/852,590.

FIELD OF THE INVENTION

The invention relates to a container with a Gas Permeable Film with high permeability towards oxygen and carbon dioxide, and is directed more particularly to such a system as is suitable for extending the shelf life of fresh fruits and vegetables (both whole and fresh cut).

BACKGROUND

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor.

The packaging systems provided in the art range from basic low density polyethylene bags to fairly sophisticated high oxygen transmission rate gas permeable membranes.

SUMMARY

Some shortcomings of such packaging systems include the inability to establish ideal oxygen and carbon dioxide atmosphere levels inside the packaging simultaneously. Typically, since the permeation rate for such packages for oxygen and carbon dioxide is same, if the oxygen atmosphere inside the package is 5% the carbon dioxide atmosphere will be 21−5=16%. So in essence the sum of oxygen and carbon dioxide levels will be 21%. Therefore, atmospheres such as 2% Oxygen and 5% Carbon Dioxide cannot be achieved.

Further, many of the packaging systems in use control and/or inhibit the growth of ethylene levels inside the package containing produce. Ethylene is a ripening agent, which is produced naturally in fresh fruits and vegetables as they respire. However, controlling the ethylene levels does not guarantee shelf life, because the oxygen levels and carbon dioxide levels need to be controlled simultaneously. Increased oxygen levels caused increased metabolic activity and hence reduction in shelf life, and increased carbon dioxide levels leads to tissue softening, and fungal and bacterial growth.

Still further, use of polyethylene bags do not have the adequate permeability needed for long term storage of produce and/or flowers. Issues such as development of anaerobic conditions when the oxygen levels go below 1% and development of high carbon dioxide levels permanently injure the produce; make the use of low density plastic bags incapable in shelf life extensions.

Accordingly, there remains room for improvement in many areas of shelf life and vase life extension technologies.

An objective of the invention is, therefore, to provide a packaging system with a high permeable film, which in essence by naturally establishing modified atmospheres inside a package containing fresh produce/can effectively extends its shelf.

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor. As the produce consumes oxygen and gives off carbon dioxide, an equilibrium gas concentration is established in the package. The gas permeable film is capable of providing different package permeabilities in order to maintain specific oxygen and carbon dioxide levels in a package and maintain this optimum atmosphere even as the temperature is changing. As the produce or other agricultural item consumes oxygen and give off carbon dioxide, the equilibrium gas concentration is established in the package. This process is a function of the permeability of the polymer and its selectivity ration of oxygen to carbon dioxide. Thus, the created atmosphere is adapted to extend shelf life, maintain high quality and preserve nutrients of fresh produce items by naturally regulating respiration of the agricultural items.

Thus the created atmosphere is able to extend shelf life, maintain high quality and preserve nutrients of fresh produce items by regulating the respiration of the targeted items. Gas Permeable Film, which allows for Carbon Dioxide gas to move in and out of the packaging at a rate many times greater than that of Oxygen. By reducing the atmospheric levels of Oxygen and increasing the atmospheric levels of Carbon Dioxide within the packaging, the ripening of fresh produce and fresh cut flowers can be delayed, the produce's respiration and ethylene production rates can be reduced, the softening of the produce can be retarded, and various compositional changes associated with produce ripening can be slowed down.

A particular configuration of the highly permeable non woven fabric based film is obtained by coating a permeable film with a thin layer of polymer, the coated system gets its structural strength from the film and the permeability from the polymer. This approach enables to reduction in the thickness of the polymer coating on the film, and yet maintains enough strength with the film, and therefore enhancing its Oxygen Permeation Rate to 55,000 cc/100 in2/day/atm, or even up to 611,000 cc/100 in2/day/atm, with carbon dioxide permeability of at least 350,000 cc/100 in2/day/atm, with a maximum permeability of 3,888,889 cc/100 in2/day/atm at 13° C.

With the above and other objects in view, as will hereinafter appear, a feature of the present invention is the provision of a packaging system including an air tight box, with a hole cutout at the center, thereof adapted to receive a permeable film, including an adhesive patch/attachment for binding the film to the cutout part of the box. A particular configuration of the Breathable Container could be designed to retrofit within home use/commercial use refrigerators, allowing shelf life extensions for perishable commodities.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIG. 1 is a simplified illustration of one form of Breathable container with the Gas Permeable Film being inserted into one form of a sliding type adjustable cartridge. The outer casing lid, hinge, slide, slide knob, and storage containers have been removed for clarity.

FIG. 2 Shows the key components of one form of the shelf life extending container. The outer casing lid and gas permeable non-woven fabric based film have been removed for clarity.

FIG. 3 Shows the exterior of one form of the shelf life extending container with the outer casing lid and outer casing lid handle installed.

FIG. 4 Shows the locations of one embodiment of the gaskets necessary to ensure air-tightness in the storage containers: the adhesive backed neoprene rubber strips.

FIG. 5 Shows one form of storage container which integrates into the larger shelf life extending container: The large storage box with sliding gates to control airflow FIG. 6. Shows one form of storage container which integrates into the larger shelf life extending container: The front small storage box with sliding gates to control airflow.

FIG. 7. Shows one form of storage container which integrates into the larger shelf life extending container: The rear small storage box with sliding gates to control airflow.

FIG. 8. Shows one form of a lid used on the storage containers: Rear small storage box lid with gaskets and adhesive backed magnetic strips which control the sliding gates in the storage containers.

FIG. 9. Shows one form of a lid used on the storage containers: Front small storage box lid with gaskets and adhesive backed magnetic strips which control the sliding gates in the storage containers.

FIG. 10. Shows one form of a lid used on the storage containers: Large storage box lid with gaskets and adhesive backed magnetic strips which control the sliding gates in the storage containers.

FIG. 11. Shows one form of an outer casing, outer casing lid, and handle used on a shelf life extending container.

FIG. 12. Shows one embodiment of the shelf life extending container fully assembled with produce in the large storage box and front small storage box. The outer casing, outer casing lid, storage boxes, slide gates, storage box covers and cartridge assembly have been made transparent for clarity.

DETAILED DESCRIPTION

The Breathable Container consists of an outer casing (1), slide housing (2), slide (3), slide knob (4), overhand platform (5), storage containers (6), a hinge (7), an outer casing lid (9) with a handle (9).

The Breathable Container's purpose is to preserve the shelf life of fresh fruits and vegetables (FF&V). It does this by controlling the atmosphere within the storage containers via a Gas Permeable film. This film is inserted into the slide housing, allowing it to cover the hole cut into the overhang platform (5). The patch is then glued around its perimeter to seal it into place, as well as provide a better air-tight seal.

The fruits and vegetables are placed within the storage containers (6), which are located within the outer casing (1). Adhesive backed neoprene rubber strips (10) are positioned on the inside lip of the overhang platform (5), as well as the back inside wall of the outer casing. This gasketing allows for an air tight fit of the storage containers (6), which in turn allows the Gas Permeable film to control the atmosphere underneath the overhang platform (5) as well as within the storage containers (6). The atmosphere within the storage containers (6) and the atmosphere underneath the overhang platform (5) are homogenous due to the entrances to the storage boxes (13,16,17,19). These entrances allow the air within the storage boxes (6) to freely flow out of the storage boxes (6) and up through the Gas Permeable film which is covering the hole cut into the overhang platform (5).

The atmosphere in the storage containers (6) is further controlled by moving the slide (3) within the slide housing (2) via the slide knob (4) over the hole cut into the overhang platform. The user slides the slide (3) to the desired numbered notch which is located on the side of the slide housing (2): Each numbered notch correlates to how affective you are allowing the Gas Permeable film to modify the atmosphere within the storage containers (6). The notched number the user would slide the leading edge of the slide (2) to depends on the quantity and type of FF&V stored within the storage containers. Adjustment of the slide (2) is necessary for any change in quantity or type of FF&V stored within the storage containers (6).

When a storage container lid is removed, its atmosphere is sealed off from the other storage containers and the atmosphere underneath the overhang platform. This is accomplished by allowing the gates (12,14,20) which are located in voids (11,15,18) between the walls of the storage containers (6) to fall when the lids are removed, sealing the entrances to the storage boxes (13,16,17,19). The gates (12,14,20) of the storage boxes (6) are conversely drawn up when the lids are on, exposing the entrances (13,16,17,19) to the storage boxes (6), which allows the atmosphere within the storage containers to once again be controlled by the Gas Permeable film. The storage containers' gates (12,14,20) are drawn up when the lids are on via the adhesive backed magnetic strips (21,24,27) which are located on the storage containers' lids. These lids are able to draw the storage containers' gates up due to the fact that the gates are constructed out of 410 stainless steel, which is magnetic.

The storage container lids also provide an airtight seal when on their corresponding storage containers via adhesive backed neoprene rubber strip (22,25,28). Each storage container lid can be removed and re-installed via its corresponding lid handle (23,26,29).

The storage boxes (6) and slide (3) can be accessed within the outer casing (1) by pushing the outer casing lid (8) upwards via the outer casing lid handle (9). The outer casing lid (8) is held in place and allowed to open via the hinge (7).

Depicted below and in accordance with the drawings are example of produce storage and more particularly to such a packaging system as is suitable for extending the shelf life of fresh fruits and vegetables (both whole and fresh cut. The configurations below include formation of the gas permeable film, or membrane, for providing particular permeability according to a predetermined transfer rate and packaging configurations employing the gas permeable non-woven fabric for storing and transporting produce products stored therein.

The gas permeable film is employed in packaging for extending the shelf life of various fresh fruits and vegetables and vase life of fresh cut flowers by changing the atmosphere in which these living products are stored and respires. The high oxygen and carbon dioxide permeability of the film establishes an ideal atmosphere for the specific perishable item, and therefore extends its shelf life. The establishment of lower oxygen and carbon dioxide atmospheres inside packages using the film also leads to reduction in the respiration rate of the perishable items. The reduction in the respiration rate prevents loss of moisture, production of metabolic heat, and yellowing, browning, reduction in production levels of ethylene. Therefore, the created atmosphere is able to extend shelf life, maintain high quality and preserve nutrients of fresh produce items by naturally regulating respiration of said produce/flower.

Formation of the Gas Permeable Film fabrication process includes creation of these films. The components for the film include polydimethyl siloxane (PDMS) base (This polydimethyl siloxane either consists of >60.0% Dimethyl siloxane, dimethylvinyl-terminated, 30.0-60.0% Dimethylvinylated and trimethylated silica, and 1.0-5.0% Tetra(trimethylsiloxy) silane, or >60.0% Dimethyl siloxane, dimethylvinyl-terminated and 30.0-60.0% Dimethylvinylated and trimethylated silica.), and curing agent mixed in the ratio 10:1, non-woven fabric (50% polyester, 50% Rayon). A mylar Rod (#3, which creates a film thickness of 0.27 MIL) was also used.

b. Mix the PDMS base and curing agent in a 10:1 ratio measured by weight c. De-gas the polymer in a desiccator for approximately 30 minutes. This removes any air bubbles resulting from the mixing process.

d. Pour this mixture on a non woven fabric, and roll the Mylar Rod #3 to form a uniform spread. Mylar rod #3 deposits a thickness of 0.27 MIL on the fabric.

e. Preheat oven for 20 minutes at 170° F. (76.6° C.).

f. Cure the PDMS-coated fabric at 170° F. (76.6° C.) for 20 minutes to promote cross-linking.

Process to design packages using the Gas Permeable Non-Woven Fabric based film. The respiration rates, ideal atmospheres, and ethylene sensitivities for various perishable items, including fresh fruits and vegetables and fresh cut flowers have been documented by University of California, Davis. The information available was utilized in designing these packages.

a. Identify the perishable item that is to have a shelf life extension. Items identified and tested have included, broccoli, cilantro, bananas, whole corn, lettuce, tomatoes, red seedless grapes, mushrooms, and strawberries.

b. For example, in the case of bananas, the respiration rates, ideal atmospheres and ideal storage temperatures were identified. The Oxygen transmission Rates (OTR) and Carbon Dioxide transmission Rates (COTR) for the Gas Permeable Non-Woven Fabric based film have already been tested by an independent test agency, Mocon Inc., of Minneapolis, Minn. The OTR and COTR values define the permeability for particular agricultural items, for example by measuring[[e]] the weight of the produce, such as bananas. In a particular configuration, the OTR and COTR for these films at 13.3° C. (an ideal temperature for bananas) tested at 111,735 and 699,000 cc/100 in^2/day/atm respectively. Using the weights, respiration rates, ideal atmospheres, COTR and OTR of these films, the surface area needed for these films can be calculated. Take the produce bag, can be low density polyethylene bag (LDPE), high density polyethylene bag (HDPE), or any other non-porous material based, used to store bananas, and cut a hole in the bag equivalent to the surface area needed for the film.

c. Using a good adhesive tape (such as electrical insulating tape), attach the Gas Permeable film at the position where the produce container has a hole.

d. Place the produce, banana inside the bag/container.

The container with the Gas Permeable will naturally attain the ideal atmospheres needed for bananas, and therefore will extend its shelf life. Testing results have successfully been able to extend the life of bananas to 20+ days.

As the produce or other agricultural items respire, they consume oxygen and give off carbon dioxide, and an equilibrium gas concentration is established in the package. This process is a function of the gas permeable film permeability and carbon dioxide to oxygen selectivity ratio. Thus, the created atmosphere (typically 2-20% oxygen and 5-15% carbon dioxide) is able to extend shelf life, maintain high quality and preserve the nutrients by naturally regulating respiration of the produce and/or agricultural items. Lower oxygen levels substantially around 2% reduce the metabolic activity of the perishable item (produce) and elevated carbon dioxide levels prevent rotting and fungal growth. Lower levels of oxygen also reduce the ethylene production of the perishable items. Predominantly perishable items with high sensitivity towards ethylene benefit from avoidance of elevated ethylene levels. Ethylene promotes ripening of bananas, and therefore lower ethylene levels tend to extend the shelf life of bananas. By changing the surface area and the thickness of the gas permeable film, the permeabilities to oxygen and carbon dioxide can be controlled, and therefore longer shelf life agricultural items such as fruits and vegetables is promoted.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

Depicted below are examples of the gas permeable film employed for storage and transportation of produce and vegetative specimens in accordance with the teachings herein. Additional information concerning post harvest conditions for various produce items may be obtained from the website for the University of California, Davis Department of Plant Sciences and other sources as known in the art.

Example 1

Using post harvest information available for bananas from the University of California, Davis Department of Plant Sciences, ideal atmospheres for bananas was 2-5% Oxygen, 2-5% Carbon Dioxide, at storage temperature of 13° C. (56° F.), with respiration rate of 38.7 ml CO2/kg·hr. With 28.6 pounds of green bananas inside a package with the Gas Permeable film, with thickness of 0.18 MIL, patch surface area was 10.9 sq, inches. Using the Gas Permeable Fabric based packaging shelf life of bananas was increased at a minimum 16 days. When compared with bananas without this packaging, the bananas turned black and mushy and were inedible just after 10 days.

Example 2

Using post harvest information available for tomato from the University of California, Davis, ideal atmospheres for strawberry was 10-15% Carbon Dioxide, at storage temperature of 0° C. (32° F.), with respiration rate of 5-10 ml CO2/kg·hr. With 9.9 pounds (4.5 kilograms) of strawberry inside a package with the Gas Permeable film, with thickness of 0.18 MIL, patch area for the film was established as 0.57 sq. inches Using the Gas Permeable film based packaging shelf life of strawberry was increased up to 12 days. When compared with strawberry without this packaging, the strawberry developed fungal growth by Day 6.

Example 3

Using post harvest information available for herbs from the University of California, Davis, ideal atmospheres for cilantro was 1-5% Oxygen, 5-15% Carbon Dioxide, at storage temperature of 0° C. (32° F.), with respiration rate of 9 ml CO2/kg·hr. With 5 pounds (2.5 kilograms) of cilantro inside a package with the Gas Permeable film, with thickness of 0.18 MIL, patch surface area for the film was 0.54 sq. inches. Using the Gas Permeable based packaging shelf life of cilantro was increased up to 21 days. When compared with cilantro without this packaging, the cilantro became dry and wilted by Day 8 and yellowed by Day 15.

Example 4

Using post harvest information available for tomato from the University of California, Davis, ideal atmospheres for tomato was 3-5% Oxygen, 3% Carbon Dioxide, at storage temperature of 13.6° C. (56° F.), with respiration rate of 15 ml CO2/kg·hr. With 11 pounds (5 kilograms) of tomato inside a package with the Gas Permeable film, with thickness of 0.18 MIL, patch surface area for the film was 1.63 sq. inches. Using the Gas Permeable based packaging shelf life of tomato was increased up to 22 days. When compared with tomato without this packaging, the tomato had fungal growth by Day 15.

Example 5

Using post harvest information available for lettuce from the University of California, Davis, ideal atmospheres for tomato was 1-3% Oxygen, at storage temperature of 5° C. (41° F.), with respiration rate of 6-10 ml CO2/kg·hr. With 11 pounds (5 kilograms) of lettuce inside a package with the Gas Permeable film, with thickness of 0.18 MIL, patch surface area for the film was established as 1.22 sq. inches. Using the Gas Permeable packaging shelf life of lettuce was increased up to 21 days. When compared with lettuce without this packaging, the lettuce developed russet browning by Day 11.

What is claimed is:

1. A breathable container comprising a thin polymer layer coated onto a permeable substrate, the coated permeable substrate having an oxygen permeability of at least 42,000 cc/100 in$^2$/day/atm and having a carbon dioxide permeability of at least 350,000 cc/100 in$^2$/day/atm, with a maximum permeability of 3,888,889 cc/100 in$^2$/day/atm, the breathable container defining a created atmosphere there within for extending the shelf life of perishable items.

2. A breathable container comprising a thin polymer layer coated onto a permeable substrate, the coated permeable having an oxygen permeability of at least 42,000 cc/100 in$^2$/day/atm, with a maximum permeability of 960,000 cc/100 in$^2$/day/atm, the breathable container defining a created atmosphere there within for extending the shelf life of multiple perishable items.

3. A breathable container comprising a thin polymer layer coated onto a permeable substrate, the coated permeable substrate having a carbon dioxide permeability of at least 350,000 cc/100 in$^2$/day/atm, with a maximum permeability of 3,888,889 cc/100 in$^2$/day/atm.

4. The breathable container according to claim 1, further comprising of multiple small compartments configured to receive multiple agricultural items.

5. The breathable container according to claim 1, further configured to integrate into refrigeration systems intended to store and/or dispense multiple perishable items.

6. The breathable container according to claim 1, further configured to integrate into permanently affixed drawers and/or cabinets.

7. The breathable container according to claim 1, further configured to comprise configurations of the porous substrates including cartridge type sliding mechanisms which internally house said porous substrates of various sizes.

8. The breathable container according to claim 1, further configured to comprise configurations of the porous substrates including non-sliding type cartridge mechanisms which internally house said porous substrates of various sizes.

9. The breathable container according to claim 1, is further configured to comprise various configurations of porous substrates including twist-lock type cartridge mechanisms which internally house said porous substrates of various sizes.

10. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 in$^2$/day/atm extends the shelf life of banana to a minimum of 5 days and to a maximum of 16 days.

11. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 in$^2$/day/atm extends the shelf life of strawberry to a minimum of 7 days and to a maximum of 14 days.

12. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 in$^2$/day/atm extends the shelf life of herbs to a minimum of 10 days and to a maximum of 32 days.

13. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 in$^2$/day/atm extends the shelf life of tomato to a minimum of 7 days and to a maximum of 18 days.

14. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 in$^2$/day/atm extends the shelf life of lettuce to a minimum of 7 days and to a maximum of 32 days.

15. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 in$^2$/day/atm extends the shelf life of fresh cut vegetables to a minimum of 7 days and to a maximum of 12 days.

16. The breathable container of claim 1 further comprising a substrate having an oxygen permeability of at least 42,000 cc/100 in$^2$/day/atm, with a maximum permeability of 960,000 cc/100 in$^2$/day/atm and having a carbon dioxide permeability of at least 350,000 cc/100 in$^2$/day/atm, with a maximum permeability of 3,888,889 cc/100 $in^2$/day/atm extends the shelf life of fresh cut fruits to a minimum of 7 days and to a maximum of 12 days.

17. The breathable container of claim 1 further comprising a substrate having an oxygen permeability of at least 42,000 cc/100 $in^2$/day/atm, with a maximum permeability of 960,000 cc/100 $in^2$/day/atm and having a carbon dioxide permeability of at least 350,000 cc/100 $in^2$/day/atm, with a maximum permeability of 3,888,889 cc/100 $in^2$/day/atm extends the shelf life of fresh salad to a minimum of 5 days and to a maximum of 10 days.

18. The breathable container according to claim 1 further configured to integrate into refrigerated commercial produce display cases where multiple breathable compartments can be integrated into a single display case unit and are further configured to have a self-adjusting sliding mechanism; where the sliding mechanism automatically adjusts to the proper position by using the contained produces' own weight to move the sliding mechanism.

19. The breathable container according to claim 1 further configured to integrate into commercial produce display cases where multiple breathable compartments can be integrated into a single display case unit and are further configured to have a self-adjusting sliding mechanism; where the sliding mechanism automatically adjusts to the proper position by using the contained produces' own weight to move the sliding mechanism.

20. The breathable container of claim 1 wherein the continuous substrate encapsulates the created atmosphere.

21. The breathable container of claim 2 wherein the continuous substrate has a permeability ratio of 6:1 with carbon dioxide.

22. The breathable container of claim 1 wherein the continuous substrate has a permeability ratio of 1:6 with oxygen.

* * * * *